US010414200B1

(12) United States Patent
Ariail

(10) Patent No.: US 10,414,200 B1
(45) Date of Patent: Sep. 17, 2019

(54) NIB FOR A CALLIGRAPHIC DIP PEN

(71) Applicant: Alan Jay Ariail, Palatine, IL (US)

(72) Inventor: Alan Jay Ariail, Palatine, IL (US)

( * ) Notice: Subject to any disclaimer, the term of this patent is extended or adjusted under 35 U.S.C. 154(b) by 0 days.

(21) Appl. No.: 16/041,820

(22) Filed: Jul. 22, 2018

(51) Int. Cl.
*B43K 1/02* (2006.01)
*B43K 1/01* (2006.01)

(52) U.S. Cl.
CPC ..... *B43K 1/02* (2013.01); *B43K 1/01* (2013.01); *B43K 1/015* (2013.01)

(58) Field of Classification Search
CPC ..... B43K 1/003; B43K 1/01; B43K 1/015; B43K 1/02; B43K 1/10
USPC ..... 401/233, 240, 254
See application file for complete search history.

(56) References Cited

U.S. PATENT DOCUMENTS

| | | | |
|---|---|---|---|
| 647,679 | A | 4/1900 | Metcalf |
| 678,703 | A | 7/1901 | Washburne |
| 701,643 | A | 6/1902 | Steifel |
| 782,540 | A | 2/1905 | Black |
| 808,469 | A | 12/1905 | McDonald |
| 825,197 | A | 7/1906 | Dodge |
| 894,368 | A | 7/1908 | Catlin |
| 1,154,332 | A | 9/1915 | Mitchell |
| 1,915,337 | A | 6/1933 | Sengbusch |
| 1,915,338 | A | 6/1933 | Sengbusch |
| 4,986,686 | A | 1/1991 | Yamanaka |
| 5,775,828 | A | 7/1998 | Ikeda |
| 5,820,285 | A | 10/1998 | Ikeda |
| 7,011,466 | B2 | 3/2006 | Iida |
| 9,815,316 | B2 | 11/2017 | Abe |
| 2011/0274478 | A1 | 11/2011 | Yamanaka |
| 2016/0243879 | A1 | 8/2016 | Chan |

FOREIGN PATENT DOCUMENTS

| | | | |
|---|---|---|---|
| EP | 2388152 | A1 | 11/2011 |
| WO | 1993014941 | A1 | 8/1993 |

OTHER PUBLICATIONS

"Ruling Pen", Wikipedia, https://en.wikipedia.org/wiki/Ruling_pen (last edited Jul. 14, 2018, created Jul. 6, 2008).
"Cola Pen Construction From Arizona Wood and SF Cans at Techshop", Instructables, https://www.instructables.com/id/Cola-Pen-Construction-From-Arizona-Wood-And-SF-Can/ (published Jun. 26, 2013).
"Parallel Pen", Pilot Pen, http://pilotpen.us/categories/calligraphy-pens/parallel-pen/ (dated via archive.org, earliest Feb. 3, 2014, latest Dec. 9, 2017).

*Primary Examiner* — David J Walczak
*Assistant Examiner* — Joshua R Wiljanen
(74) *Attorney, Agent, or Firm* — Steven L. Fisher-Stawinski

(57) ABSTRACT

A nib for a calligraphic dip pen includes a first inner plate with a first inner plate point end, a second inner plate with a second inner plate point end, and a core with a core top end. The first inner plate and said second inner plate are affixed to the core top end. The first inner plate and the second inner plate are bent toward an axial line of the core such that the first inner plate point end and the second inner plate point end are in contact. The nib for a calligraphic dip pen further includes a spacer plate positioned against either the first inner plate or the second inner plate. The spacer plate includes a spacer plate point end positioned in contact with both the first inner plate and the second inner plate.

20 Claims, 9 Drawing Sheets

NIB FOR A CALLIGRAPHIC DIP PEN

BACKGROUND OF THE INVENTION

The invention relates generally to writing and drawing implements, and in particular to nibs for reservoir-less dip pens for drawing and calligraphy.

Together with ink and parchment, the dip pen (originally a feather quill) is ancient technology. While long since supplanted for everyday use by pens that include a reservoir, for example, fountain pens, cartridge pens, ballpoint pens, and felt tip pens, the reservoir-less dip pen remains in use with artists and calligraphers. Reservoir-less dip pens continue to provide superior and widely varied marks that can be made by combining different nib shapes and materials with a skilled hand. To date, many cartridge-based and other reservoir pens have been proposed, but artists and calligraphers continue to find that some marks and styles can only be achieved with dip pens of various nib configurations.

At the same time, reservoir-less dip pens continue to suffer the same drawbacks that they have for centuries—namely—that the dipped nib is limited in the amount of ink that it can hold. Typically, dip pen nibs can carry a load of ink that lasts for at most a few letters of calligraphy. A dip pen nib that offers the flexibility and variedness of styles while being able to hold a bit more ink, but without the drawbacks of having to be in fluid communication with an ink reservoir, would be an improvement to the art.

SUMMARY OF THE INVENTION

A nib for a calligraphic dip pen includes a first inner plate with a first inner plate point end, a second inner plate with a second inner plate point end, and a core with a core top end. The first inner plate and said second inner plate are affixed to the core top end. The first inner plate and the second inner plate are bent toward an axial line of the core such that the first inner plate point end and the second inner plate point end are in contact. The nib for a calligraphic dip pen further includes a spacer plate positioned against either the first inner plate or the second inner plate. The spacer plate includes a spacer plate point end positioned in contact with both the first inner plate and the second inner plate.

According to an aspect of the invention, the nib for calligraphic dip pen includes a spacer plate with a spacer plate point end and a spacer plate base end, a first inner plate with a first inner plate point end and a first inner plate base end, and a second inner plate with a second inner plate point end and a second inner plate base end. The spacer plate point end is inserted tensionally between the first inner plate point end and the second inner plate point end. The first inner plate base end, second inner plate base end, and spacer plate base end are affixed to a substrate. The first inner plate, second inner plate, and spacer plate are configured in a manner effective to dispense a quantity of ink stored therebetween when deformed relative to one another.

According to an aspect of the invention, the nib for a calligraphic dip pen includes a first inner plate with a first inner plate point end and a first inner plate base end, a second inner plate with a second inner plate point end and a second inner plate base end, and a core. The core includes a core top end with a first core slot and a second core slot cut into the core top end. The first and second core slots are aligned parallel to one another and to an axial line of the core, and they are positioned distally in opposing directions along a first transverse line of the core. The first transverse line of the core is perpendicular to the axial line of the core.

The first inner plate base end is retained within the first core slot. The second inner plate base end is retained within the second core slot. The first inner plate and second inner plate are bent toward the axial line of the core such that the first inner plate point end and the second inner plate point end are in contact. The nib further includes a spacer plate with a spacer plate point end and a spacer plate base end. The spacer plate is positioned against either the first inner plate or the second inner plate such that the spacer plate base end is inserted into either the first or second core slot. The spacer plate point end is positioned in contact with both the first inner plate and said second inner plate.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 1:
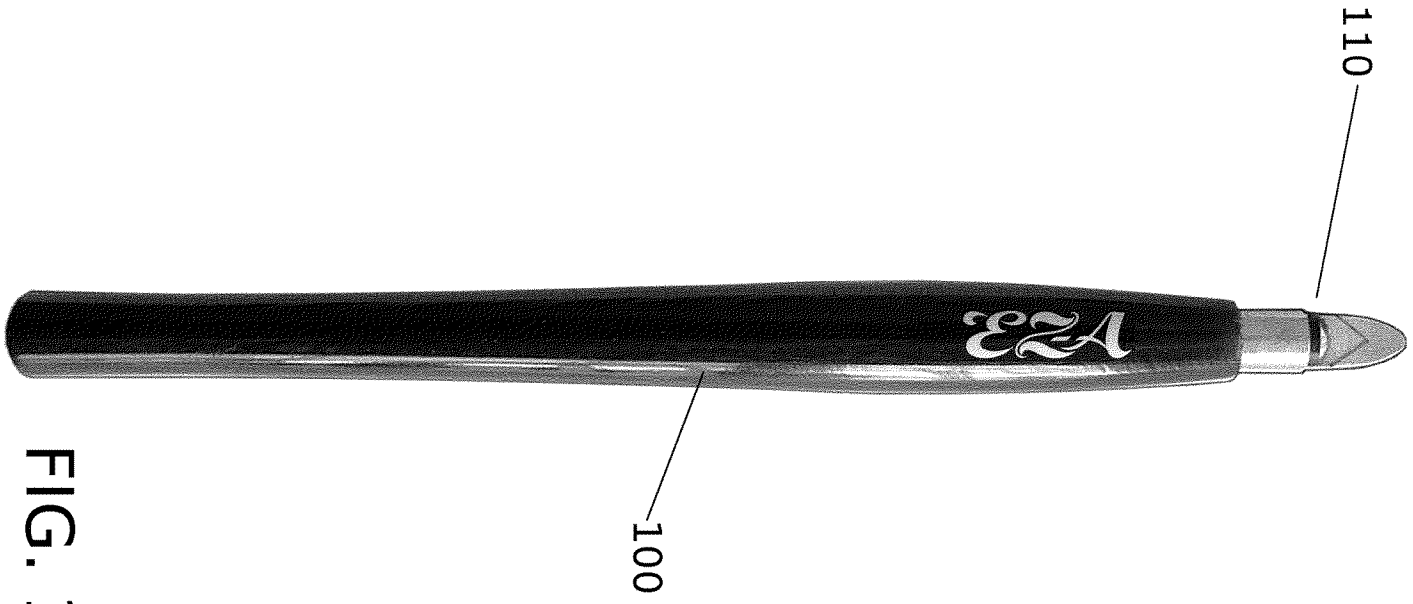
FIG. 1 is a front view of a calligraphic dip pen incorporating a nib, in accordance with at least one embodiment of the invention.

Referring now to the invention in more detail, the invention is directed to a nib for a calligraphic dip pen. FIG. 1 shows a front view of a calligraphic dip pen, in accordance with at least one embodiment of the invention. A pen handle 100 generally receives a pen nib 110. The pen handle 100, generally, is a rigid elongated member. In various embodiments, a bulge or other ergonomic shape to the pen handle 100 may be provided. The pen handle 100 may be made of any of various wood, plastic, or metal materials. In various embodiments, the pen handle 100 generally lacks an ink reservoir, as various embodiments of the invention are intended as dip pens with no ability to store ink beyond that which clings to the nib when the nib is dipped in the ink. The pen handle 100 may receive the pen nib 110 tensionally, for example by inserting the nib 110 into a tightly fitted receiving hole in the pen handle 100. In alternative embodiments, the pen nib 110 may screw into the pen handle 100 or be affixed via adhesives or mechanical fasteners.

Figure 2:
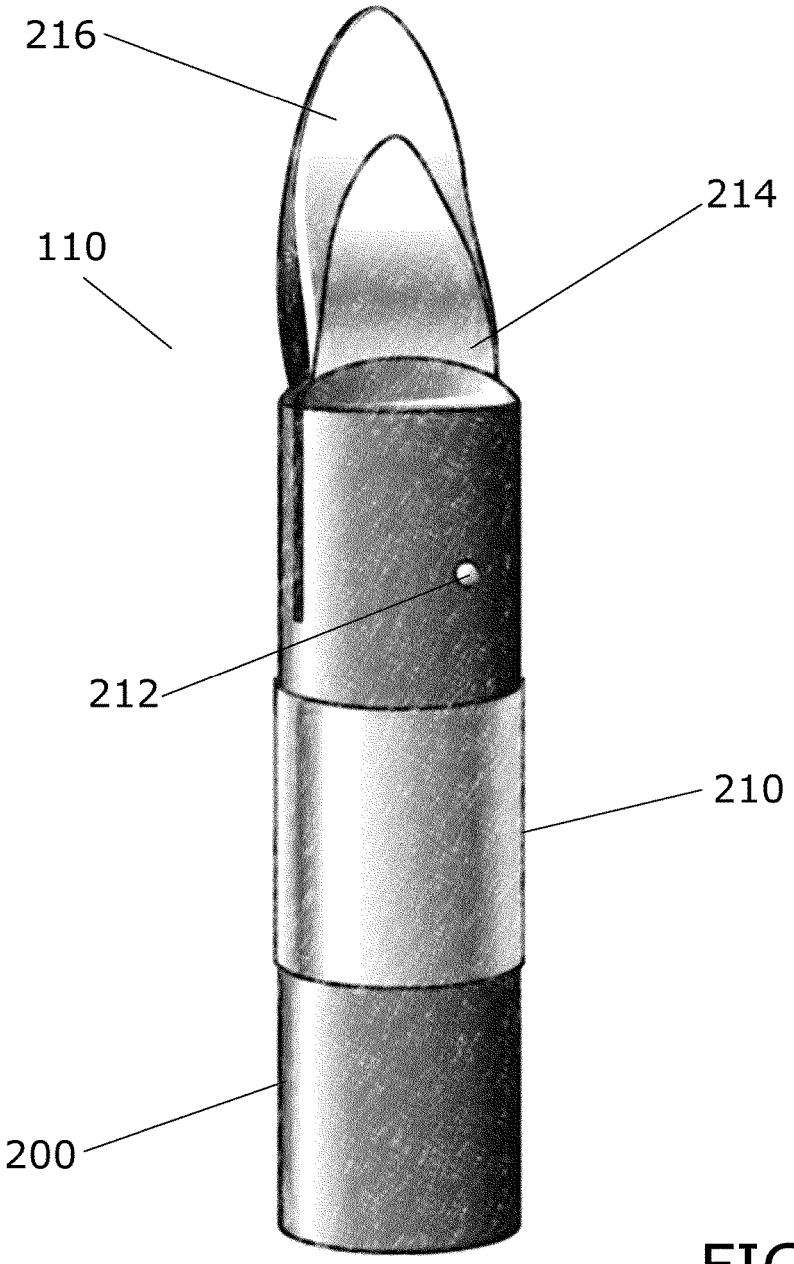
FIG. 2 is a front-perspective view of a nib for a calligraphic dip pen with the cylindrical sleeve lowered, in accordance with at least one embodiment of the invention.
Figure 5A:
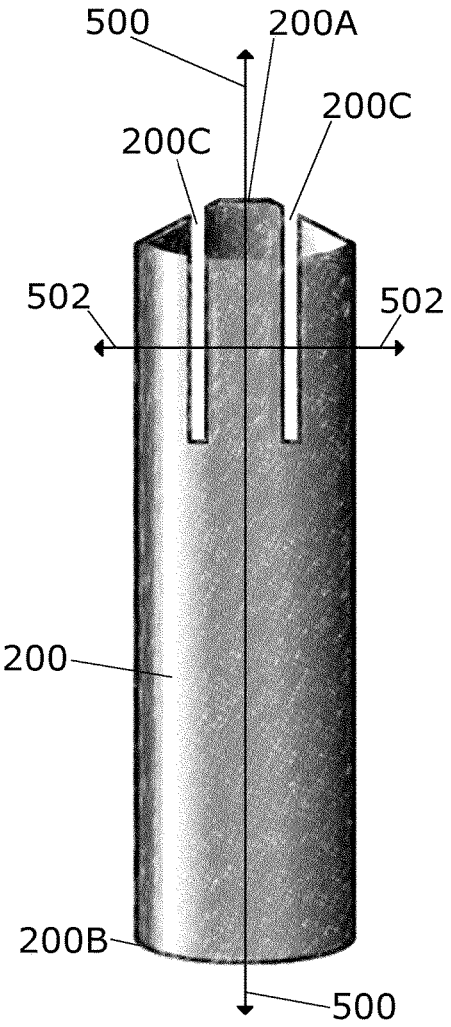
FIG. 5A is a side view of a core for a calligraphic dip pen, in accordance with at least one embodiment of the invention.
Figure 5B:
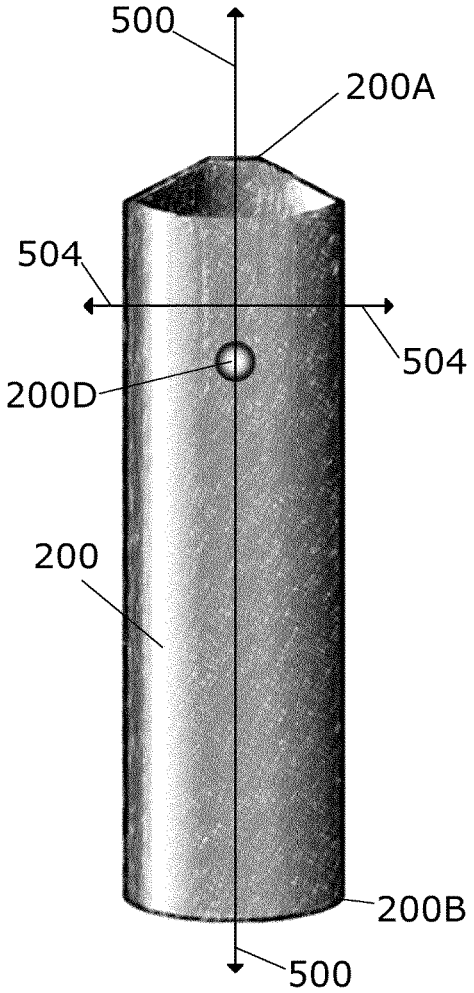
FIG. 5B is a front view of a core for a calligraphic dip pen, in accordance with at least one embodiment of the invention.
Figure 5C:
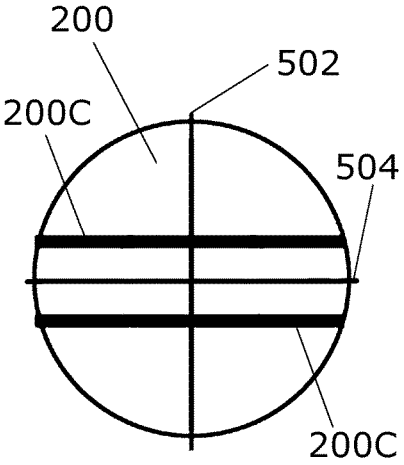
FIG. 5C is a top view of a core for a calligraphic dip pen, in accordance with at least one embodiment of the invention.

Referring now to FIG. 2, FIG. 2 depicts a front-perspective view of a pen nib 110, in accordance with at least one embodiment of the invention. In the depicted embodiment, a core 200 is provided. The core 200 may be a rigid cylinder tapered at its top end 200A. In various embodiments, the core 200 may be made of polyoxymethlene, known commercially as Delrin, which has been observed by the Inventor to be advantageous for its high stiffness and low friction, particularly with the various metal parts described herein. Alternative materials for the core 200 include other thermoplastics and thermoset plastics, as well as various wood, metal, or ceramic materials. FIG. 5A depicts a side view of the core 200, which includes a core top end 200A, a core bottom end 200B, and a pair of core slots 200C. A core axial line 500 denotes the centerline of longest dimension of the core 200. The core slots 200C may be understood as cut into the core top end 200A and positioned in planes orthogonal to a first core transverse line 502 and (optionally equally) distal to the core axial line 500. The planes in which the core slots 200C sit may be understood to be parallel to a second core axial line 504, shown in FIG. 5B, which is perpendicular to both the core axial line 500 and the first core transverse line 502. FIG. 5B also depicts a core pin hole 200D, which, in the depicted embodiment, is aligned with the first core transverse line 502 and penetrates both of the core slots 200C. FIG. 5C shows a top view of the core 200 with the first and second transverse lines 502 and 504 shown in relation to the core slots 200C. Exemplary dimensions for the core 200 are 6.35 mm (0.25 in) in diameter and 20 mm in length with the core slots cut 1.6 mm apart, centered about the core axial line 500 and 9.45 mm deep. The pin hole 200D may be 1.29 mm (16 gauge or 0.052 in) in diameter and may be positioned 4.5 mm from the bottom of the core slots 200C and centered horizontally at that height. In alternative embodiments, the core 200 and core pin hole 200D may be of rectangular or other non-cylindrical shape. More generally, the core 200 may be understood as replaced with any substrate.

Figure 3:
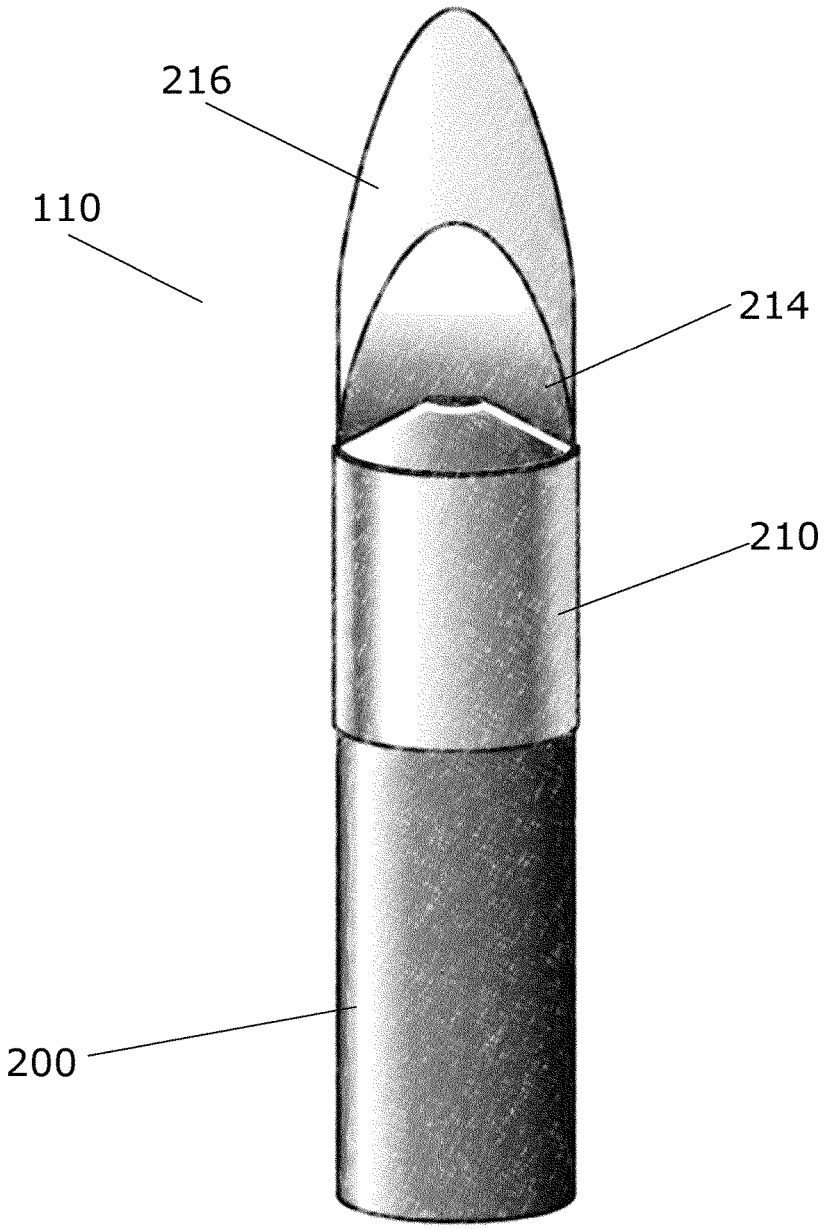
FIG. 3 is a front view of a nib for a calligraphic dip pen, in accordance with at least one embodiment of the invention.

Referring still to FIG. 2, a pair of inner plates 216 are inserted into the core slots 200C and are urged toward each other by a pair of outer plates 214. The various plate components are secured to the core 200 via the pin 212, which passes through the core pin hole 200D and through corresponding holes in the various plate components, described in further detail below. A cylindrical sleeve 210 is shown in FIG. 2 in a slid-down configuration allowing for access to the pin 212. FIG. 3 depicts the same components in with the cylindrical sleeve 210 in a slid-up configuration.

Figure 4:
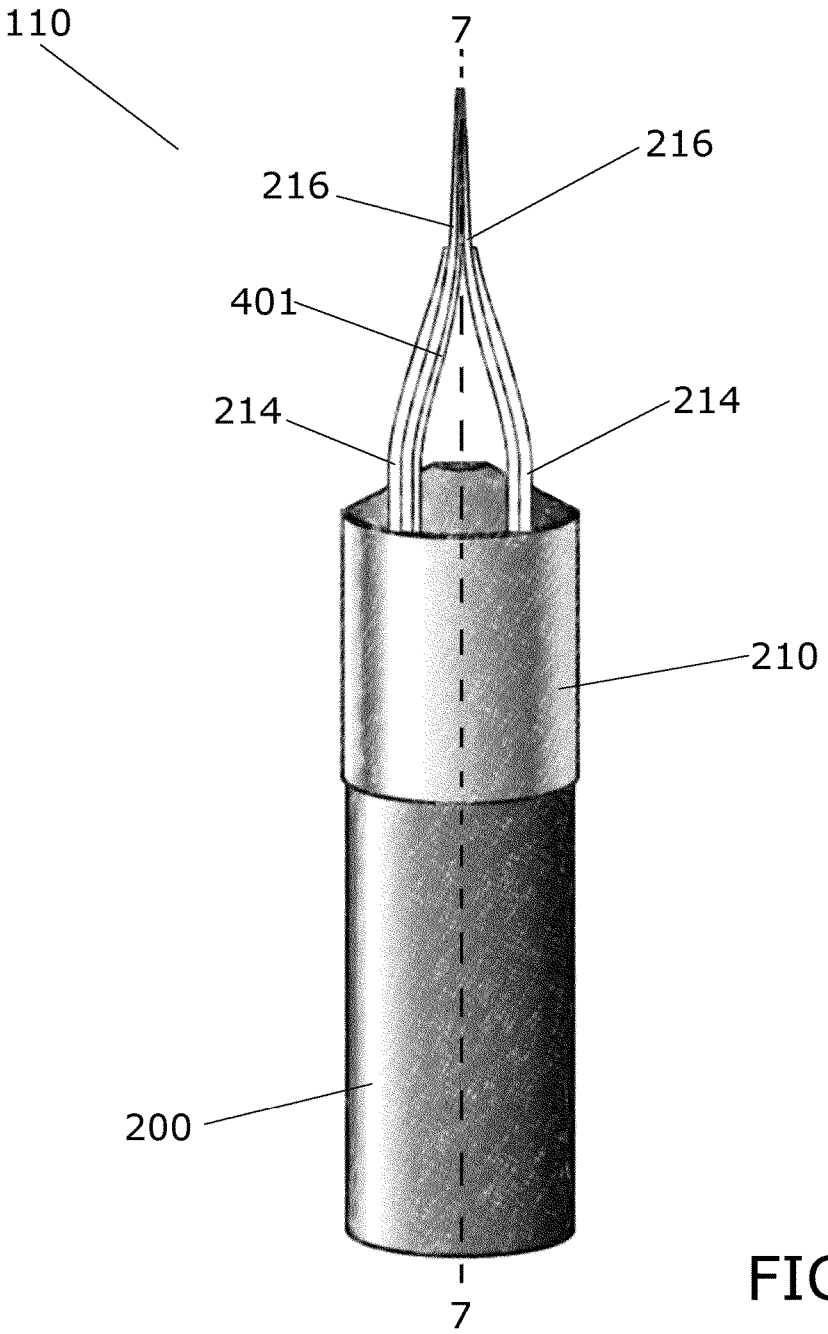
FIG. 4 is a side view of a nib for a calligraphic dip pen, in accordance with at least one embodiment of the invention.

Referring now to FIG. 4, FIG. 4 shows a side view of the pen nib 110 and its components. A spacer plate 401 sits against either of the inner plates 216 and is inserted into either of the core slots 200C together with that inner plate 216 against which it is positioned. FIG. 6C shows the inner plates 216, outer plates 214, and space plate 401 in exploded position. As shown, each inner plate 216 has an inner plate point end 216A and an inner plate base end 216B, each outer plate 214 has an outer plate point end 214A and an outer plate base end 214B, and the spacer plate has a spacer plate point end 401A and a spacer plate base end 401B. Each of the various plate elements is bent so that the point end is relatively inward from the base end with the respect to the axial line of the pen and nib combination. Equivalently, the first and second inner plates 216 may be understood as bent toward the core axial line 500 such that the inner plate point ends 216A are in contact with one another. Also, as shown, the spacer plate point end 401A may be understood as in contact with both of the inner plates 216. Equivalently, the spacer plate point end 401A may be understood as inserted tensionally between the inner plate point ends 216A. As used herein, "in contact with", means in direct contact or separated by no more than the thickness of any of the various plate components, when the plates are in an equilibrium position—that is, when not deformed temporarily during the process of writing.

Figure 9A:
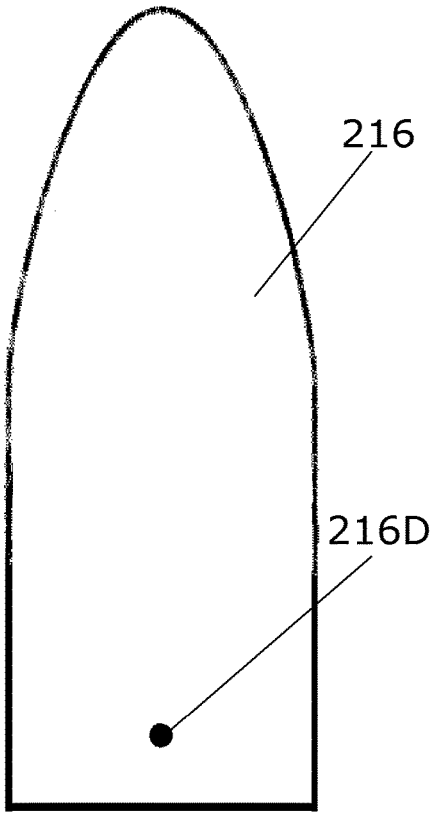
FIG. 9A is a front view of an inner plate of a nib for a calligraphic dip pen, in accordance with at least one embodiment of the invention.
Figure 9B:
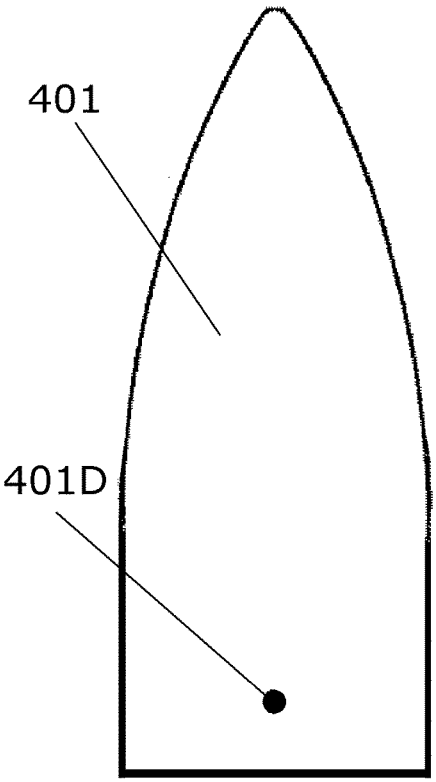
FIG. 9B is a front view of a spacer plate of a nib for a calligraphic dip pen, in accordance with at least one embodiment of the invention.
Figure 9C:
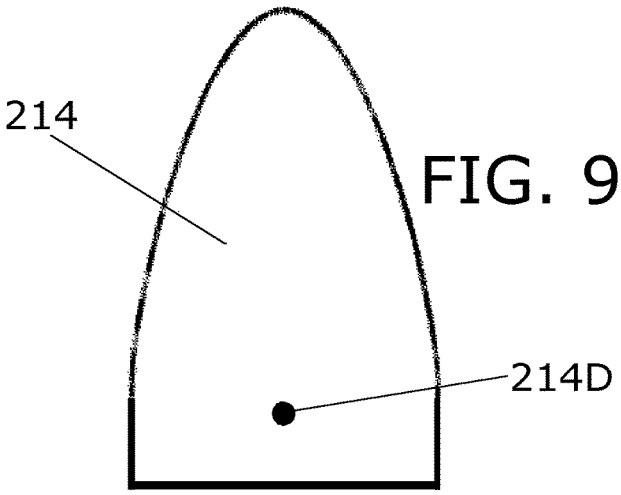
FIG. 9C is a front view of an outer plate of a nib for a calligraphic dip pen, in accordance with at least one embodiment of the invention.

FIG. 9A is a front view of an exemplary inner plate 216 with inner plate pin hole 216D. FIG. 9B is a front view of an exemplary spacer plate 401 with spacer plate pin hole 401D. FIG. 9C is a front view of an exemplary outer plate 214 with outer plate pin hole 214D. In various embodiments, the various plate components are shaped relative to one another as shown in FIG. 9A-9C. Specifically, the inner plate 216 provides the principle writing edge that interacts with the paper or other writing surface. Accordingly, the inner plate point end 216A may be shaped with a parabola-like curve, as shown, or with another shape according to the artistic preference of the user. The spacer plate 401 may be shaped slightly shorter than the inner plate 216 and with a tighter or steeper curvature, as shown, such that when the inner plate 216 and spacer plate 401 are placed against one another (see FIG. 7), the inner plate 216 extends beyond the spacer plate 401 in the upward vertical direction and both horizontal directions. In an alternative embodiment, the spacer plate may be shaped with a concave curvature instead of the convex curvature of the depicted embodiment. The outer plate 214 may be shaped like the inner plate 216, but significantly reduced, as shown. FIG. 3 shows the relative heights of the inner plater 216 with the outer plate 214. Exemplary dimensions for the inner plate 216 are 20 mm in length and 6 mm in width, with the curve of the outer plate point end 216A beginning 14 mm up from the inner plate base end 116B. Exemplary dimensions for the outer plate 214 are 14 mm in length and 6 mm in width, with the curve beginning 7.6 mm from the outer plate base end 214B (or 6.4 mm from the outer plate point end 214A). Exemplary dimensions for the spacer plate 401 are 19 mm in length and 6 mm in width, with the curve beginning 9 mm from the spacer plate base end 401B.

Generally, the material of the various plate components (inner plate 216, outer plate 214, and spacer plate 401) is steel. Specifically, the inner plate 216 and spacer plate 401 may be made of stainless steel, and the outer plate 214 may be made of spring steel. The spacer plate 401 may be of a thickness 0.1016 mm (0.04 in) or less. The inner plate 216 may be between 0.0762 mm (0.03 in) and 1.2700 mm (0.05 in) in thickness. The outer plate may be between 0.1016 mm (0.04 in) and 1.5240 mm (0.06 in) in thickness.

Figure 6A:
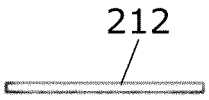
FIG. 6A is a side view of a pin for a calligraphic dip pen, in accordance with at least one embodiment of the invention.

Referring now to FIG. 6A, FIG. 6A shows a side view of the pin 212. The pin 212 may be cylindrical in shape, may be made of brass and sized to fit snugly into the core pin hole 200D. In alternative embodiments, one or both ends of the pin 212 may include a pinhead that is effective to prevent the pin 212 from sliding within the core pin hole 200D. In an assembled pen nib 110, the pin 212 passes through the core pin hole 200D, both of the outer plate pin holes 214D, both of the inner plate pin holes 216D, and the spacer plate pin hole 401D.

Figure 6B:
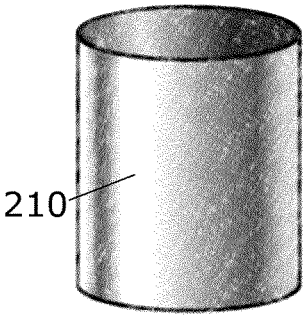
FIG. 6B is a front-elevated view of a cylindrical sleeve for a calligraphic dip pen, in accordance with at least one embodiment of the invention.
Figure 6C:
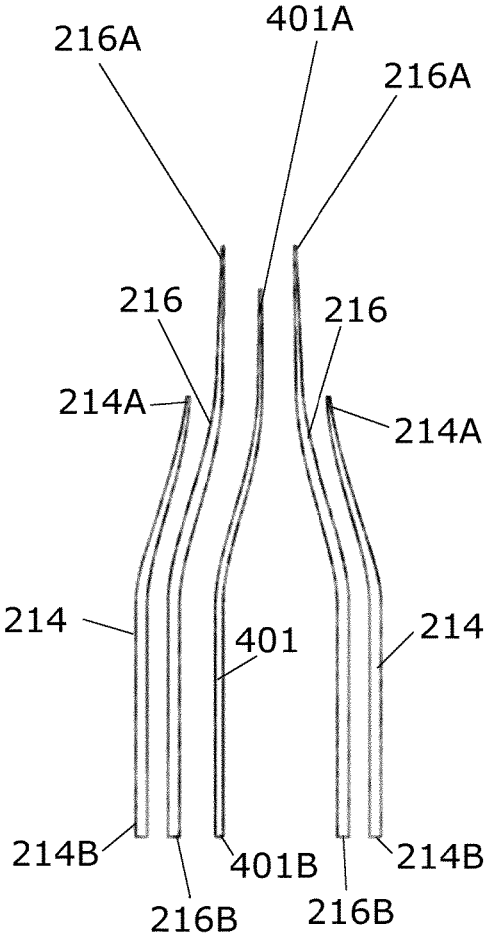
FIG. 6C is a side-exploded view of various plate components of a nib for a calligraphic dip pen, in accordance with at least one embodiment of the invention.

Referring now to FIG. 6B, FIG. 6B shows a front elevated view of the cylindrical sleeve 210. The cylindrical sleeve 210 may be sized complementarily with the core 200 such that the cylindrical sleeve 200 slides snugly but easily over the core 200. When slid over the core pin hole 200D, the cylindrical sleeve 210 may be understood as effective to retain the pin 212 within the core pin hole 200D. The cylindrical sleeve 210 may be further understood as effective to surround the core slots 200C.

The cylindrical sleeve 210 and pin 212 may be made of a rigid metal material such as brass. In particular, the Inventor has observed that brass has a desirable coefficient of friction with polyoxymethlene (Delrin) when that material is used in the core 200, allowing for the various components to be retained frictionally while still being easily removed for disassembly and reassembly of the nib 110.

Figure 7:
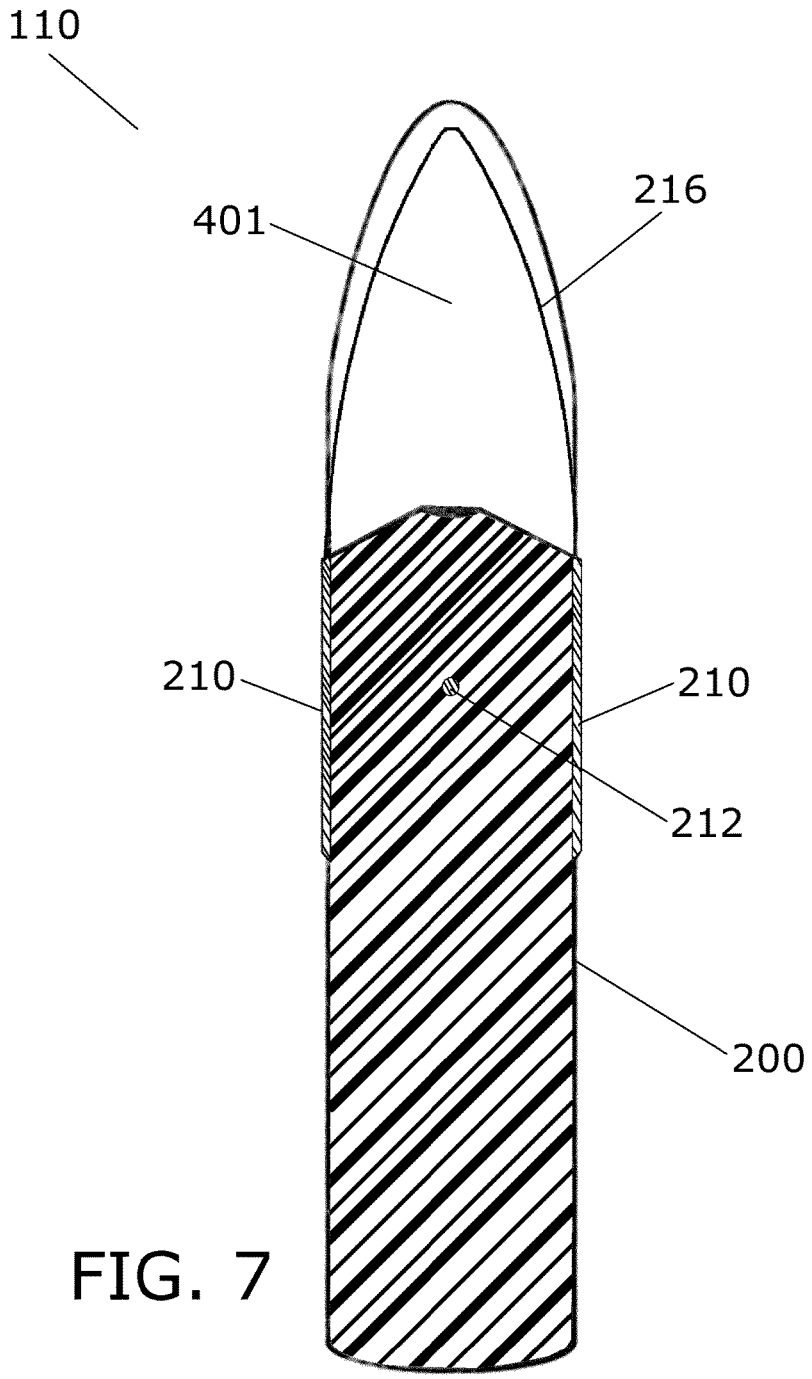
FIG. 7 is a cross-sectional view, along the plane designated in FIG. 4, of a nib for a calligraphic dip pen, in accordance with at least one embodiment of the invention.

Referring now to FIG. 7, FIG. 7 depicts a cross section of the assembled nib 110 along the plane identified in FIG. 4 and looking toward the side that has the spacer plate 401. As shown, the spacer plate 401 is of similar, but reduced shape to the inner plate 216.

Figure 8A:
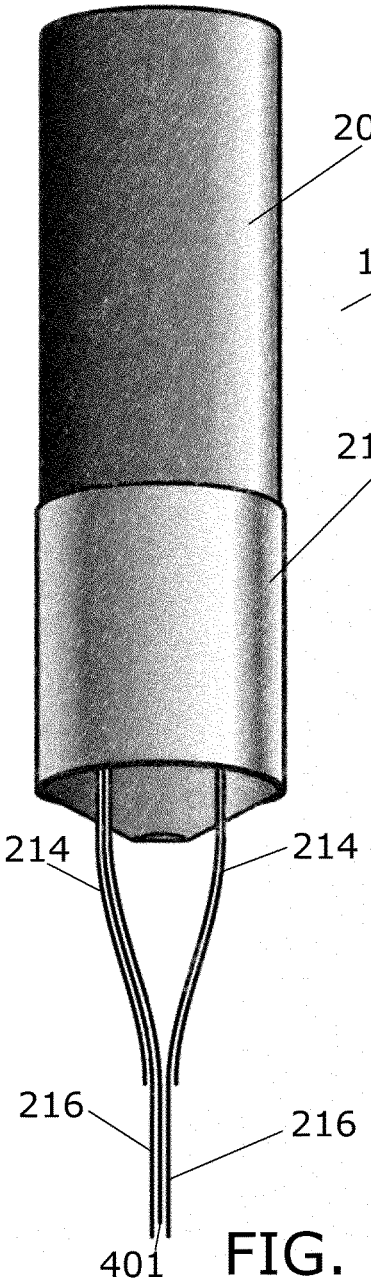
FIG. 8A is an inverted side view of a nib for a calligraphic dip pen with various plate elements in schematic isolation, in accordance with at least one embodiment of the invention.
Figure 8B:
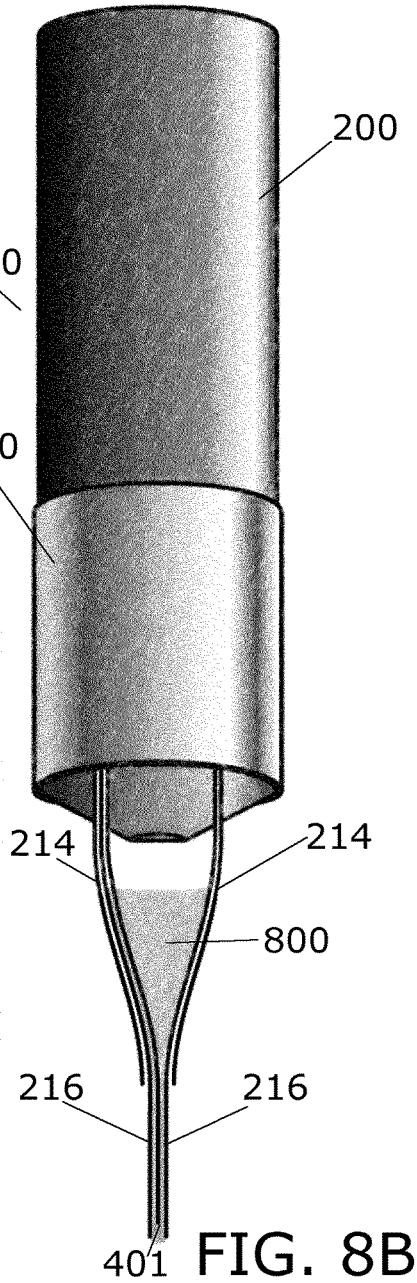
FIG. 8B is an inverted side view of a nib for a calligraphic dip pen with various plate elements in schematic isolation and a schematic representation of quantity of ink loaded, in accordance with at least one embodiment of the invention.

FIG. 8A and FIG. 8B depict a schematic representation of the various plate components on an inverted nib 110. A quantity of ink 800 may be drawn between and/or among the various plate components, as shown, by capillary action, by dipping the inverted nib 110 into an external reservoir of ink. Generally, the inner plates 216 and spacer plate 401 may be understood as configured in a manner effective to draw in the quantity of ink 800 and store it therebetween. The Inventor has observed that the quantity of ink that can be retained between and/or among the various plate components is much greater than for a conventional dip pen. For example, instead of ink sufficient for a few letters to a work, the quantity of ink 800 has been observed to be sufficient for between a half and a full page of text, assuming common lettering and paper sizes.

In use, pressing the inner plates 216 against a paper or other writing surface will tend to deform the various plate components 214, 216, and 401, and in particular, the two inner plates 216 will tend to slide relative to one another and to the spacer plate 401, allowing ink from the quantity of ink 800 to be released at usable rate. By adjusting the angle and pressure of application, those skilled in the art of nib pen calligraphy and drawing will be able to produce a wide variety of marks and styles. In general, the inner plates 216 and spacer plate 401 may be understood as configured in a manner effective to dispense a quantity of ink stored therebetween when deformed relative to one another.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A nib for a calligraphic dip pen, comprising:

a first inner plate comprising a first inner plate point end;

a second inner plate comprising a second inner plate point end;

a core comprising a core top end;

said first inner plate and said second inner plate being affixed to said core top end;

said first inner plate and said second inner plate being bent toward an axial line of said core such that said first inner plate point end and said second inner plate point end are in contact;

a spacer plate positioned against either said first inner plate or said second inner plate; and said spacer plate comprising a spacer plate point end positioned in contact with both said first inner plate and said second inner plate.

2. The nib for a calligraphic dip pen of claim 1, further comprising a first outer plate affixed to said core top end, said first outer plate being positioned against said first inner plate and configured to urge said first inner plate toward said second inner plate.

3. The nib for a calligraphic dip pen of claim 2, further comprising a second outer plate affixed to said core top end, said second outer plate being positioned against said second inner plate and configured to urge said second inner plate toward said first inner plate.

4. The nib for a calligraphic dip pen of claim 1, wherein said first inner plate, said second inner plate, and said spacer plate are configured in a manner effective to draw in a quantity of ink and store said quantity of ink therebetween.

5. The nib for a calligraphic dip pen of claim 1, wherein said first inner plate, said second inner plate, and said spacer plate are configured in a manner effective to dispense a quantity of ink stored therebetween when deformed relative to one another.

6. The nib for a calligraphic dip pen of claim 1, wherein said core is affixed to a pen handle to form a pen.

7. A nib for a calligraphic dip pen, comprising:

a spacer plate comprising a spacer plate point end and a spacer plate base end;

a first inner plate comprising a first inner plate point end and a first inner plate base end;

a second inner plate comprising a second inner plate point end and a second inner plate base end;

said spacer plate point end being inserted tensionally between said first inner plate point end and said second inner plate point end;

said first inner plate base end, said second inner plate base end, and said spacer plate base end being affixed to a substrate; and said first inner plate, said second inner plate, and said spacer plate being configured in a manner effective to dispense a quantity of ink stored therebetween when deformed relative to one another.

8. The nib for a calligraphic dip pen of claim 7, further comprising a first outer plate affixed to said substrate, said first outer plate being positioned against said first inner plate and configured to urge said first inner plate toward said second inner plate.

9. The nib for a calligraphic dip pen of claim 8, further comprising a second outer plate affixed to said core top end against said second inner plate, said second outer plate being configured to urge said second inner plate toward said first inner plate.

10. The nib for a calligraphic dip pen of claim 7, wherein said first inner plate, said second inner plate, and said spacer plate are configured in a manner effective to draw in and store said quantity of ink therebetween.

11. The nib for a calligraphic dip pen of claim 7, wherein said substrate is affixed to a pen handle to form a pen.

12. A nib for a calligraphic dip pen, comprising:

a first inner plate comprising a first inner plate point end and a first inner plate base end;

a second inner plate comprising a second inner plate point end and a second inner plate base end;

a core comprising a core top end;

a first core slot and a second core slot cut into said core top end, said first and second core slots being aligned parallel to one another and to an axial line of said core and being positioned distally in opposing directions along a first transverse line of said core, said first transverse line of said core being perpendicular to said axial line of said core;

said first inner plate base end being retained within said first core slot, and said second inner plate base end being retained within said second core slot;

said first inner plate and said second inner plate being bent toward said axial line of said core such that said first inner plate point end and said second inner plate point end are in contact; and a spacer plate comprising a spacer plate point end and a spacer plate base end;

said spacer plate being positioned against either said first inner plate or said second inner plate such that said spacer plate base end is inserted into either said first or second core slot; and said spacer plate point end being positioned in contact with both said first inner plate and said second inner plate.

13. The nib for a calligraphic dip pen of claim 12, further comprising a first outer plate affixed to said core top end, said first outer plate being positioned against said first inner plate and configured to urge said first inner plate toward said second inner plate.

14. The nib for a calligraphic dip pen of claim 13, further comprising a second outer plate affixed to said core top end, said second outer plate being positioned against said second inner plate and configured to urge said second inner plate toward said first inner plate.

15. The nib for a calligraphic dip pen of claim 14, wherein a pin hole passes through said core, said first outer plate, said first inner plate, said spacer plate, said second inner plate, and said second outer plate; and further comprising a pin passed through said pin hole in a manner effective to retain said first outer plate, said first inner plate, said spacer plate, said second inner plater, and said second outer plate to said core.

16. The nib for a calligraphic dip pen of claim 15, wherein said core is inserted into a cylindrical sleeve in a manner effective to retain said pin in said pin hole.

17. The nib for a calligraphic dip pen of claim 12, wherein said core is inserted into a cylindrical sleeve in a manner effective to surround said first core slot and said second core slot.

18. The nib for a calligraphic dip pen of claim 12, wherein said first inner plate, said second inner plate, and said spacer plate are configured in a manner effective to draw in a quantity of ink and store said quantity of ink therebetween.

19. The nib for a calligraphic dip pen of claim 12, wherein said first inner plate, said second inner plate, and said spacer plate are configured in a manner effective to dispense a quantity of ink stored therebetween when deformed relative to one another.

20. The nib for a calligraphic dip pen of claim 12, wherein said core is affixed to a pen handle to form a pen.

* * * * *